US010180313B2

(12) United States Patent
Edström et al.

(10) Patent No.: US 10,180,313 B2
(45) Date of Patent: Jan. 15, 2019

(54) ELECTRIC DETONATOR AND METHOD FOR PRODUCING AN ELECTRIC DETONATOR

(71) Applicant: SAAB AB, Linköping (SE)

(72) Inventors: Karl Edström, Kristinehamn (SE); Johan Östlund, Örebro (SE)

(73) Assignee: SAAB AB, Linköping (SE)

( * ) Notice: Subject to any disclaimer, the term of this patent is extended or adjusted under 35 U.S.C. 154(b) by 0 days.

(21) Appl. No.: 14/781,405

(22) PCT Filed: Nov. 7, 2013

(86) PCT No.: PCT/SE2013/000171
§ 371 (c)(1),
(2) Date: Sep. 30, 2015

(87) PCT Pub. No.: WO2015/069152
PCT Pub. Date: May 14, 2015

(65) Prior Publication Data

US 2016/0054111 A1 Feb. 25, 2016

(51) Int. Cl.
*F42B 3/16* (2006.01)
*F42C 19/12* (2006.01)
(Continued)

(52) U.S. Cl.
CPC ..... *F42C 19/12* (2013.01); *F42B 3/124* (2013.01); *F42B 3/128* (2013.01); *F42B 33/001* (2013.01)

(58) Field of Classification Search
CPC .. F42B 3/103; F42B 3/11; F42B 3/124; F42B 3/128; F42B 3/16
See application file for complete search history.

(56) References Cited

U.S. PATENT DOCUMENTS 2,965,033 A * 12/1960 Horne ..... F42B 3/198 102/202.14
3,125,954 A * 3/1964 Vilbajo ..... F42B 3/124 102/202.8
(Continued)

FOREIGN PATENT DOCUMENTS

CN 1847776 A 10/2006
CN 101448762 A 6/2009
(Continued)

OTHER PUBLICATIONS

Extended European Search Report dated Jun. 14, 2017 in Patent Application No. 13896905.0.
(Continued)

*Primary Examiner* — Derrick R Morgan
(74) *Attorney, Agent, or Firm* — Venable LLP; Jeffri A. Kaminski

(57) ABSTRACT

The present invention relates to an electric detonator (1) comprising a cap (2), comprising a priming charge (3) and an electrode (4), comprising a positive pole, a negative pole and a resistor element (8), the said priming charge (3) comprising at least two primary explosives, a first primary explosive (9) and a second primary explosive (10), and at least one secondary explosive (11). The electric detonator is characterized in that the two primary explosives (9, 10) and the secondary explosive (11) are arranged in layers, in an increasing degree of sensitivity, bearing one against the other, wherein the first primary explosive (9), constituting the most sensitive of the two primary explosives (9, 10), is arranged closest to the resistor element (8), and in that the second primary explosive (10) is arranged thereafter between the first primary explosive (10) and the secondary explosive (11). The invention also relates to a production method for the said electric detonator (1).

11 Claims, 1 Drawing Sheet

(51) Int. Cl.
*F42B 3/12* (2006.01)
*F42B 33/00* (2006.01)

(56) References Cited

U.S. PATENT DOCUMENTS 3,186,341 A * 6/1965 Bjorklund ..... F42C 19/0815 102/202.8
3,188,914 A * 6/1965 Dahl ..... F42B 3/124 102/202.14
3,351,012 A * 11/1967 Wilson ..... F42B 3/18 102/202.2
3,366,055 A * 1/1968 Hollander, Jr. ..... F42B 3/13 102/202.7
3,371,607 A * 3/1968 Olsson ..... C06C 5/00 102/202.3
3,372,640 A * 3/1968 Dow ..... F42B 3/192 102/202.14
3,541,961 A * 11/1970 Larson ..... F42B 3/124 102/202.6
3,589,294 A * 6/1971 Stresau ..... F42C 15/40 102/202.8
3,618,523 A * 11/1971 Hiquera ..... C06C 7/00 102/202.1
3,686,934 A * 8/1972 Farrand ..... F42B 3/195 102/202.7
3,793,920 A * 2/1974 Sheran ..... F42B 3/14 102/202.8
4,156,390 A * 5/1979 Ferguson ..... F42C 19/12 102/202.8
4,239,005 A * 12/1980 Simmons ..... F42B 3/12 102/202.13
4,497,251 A * 2/1985 Rucker ..... C06B 33/00 102/202.6
4,527,481 A * 7/1985 Evans ..... C06C 7/00 102/204
4,819,560 A * 4/1989 Patz ..... F42B 3/13 102/200
4,907,509 A * 3/1990 Lieberman ..... F42B 3/128 102/202.1
5,052,300 A * 10/1991 Josse ..... G02B 7/02 102/201
5,088,412 A * 2/1992 Patrichi ..... C06C 5/06 102/202.13
5,385,098 A * 1/1995 Lindqvist ..... C06C 7/00 102/202.5
5,487,559 A * 1/1996 Headley ..... B60R 21/0173 280/735
5,621,183 A * 4/1997 Bailey ..... F42B 3/124 102/202.14
5,639,986 A * 6/1997 Evans ..... B60R 21/2644 102/202.1
5,798,476 A 8/1998 Bailey
5,845,578 A * 12/1998 Fogle, Jr. ..... F42B 3/11 102/202.5
5,847,309 A * 12/1998 Baginski ..... F42B 3/13 102/202.2
5,939,660 A * 8/1999 Fogle, Jr. ..... C06C 7/00 102/202.7
5,945,627 A * 8/1999 Arpin ..... C06C 7/00 102/202.11
6,007,096 A * 12/1999 Shirk ..... B60R 21/272 280/736
6,105,503 A 8/2000 Baginski
6,305,286 B1 * 10/2001 Fogle, Jr. ..... C06C 7/00 102/202.5
6,324,979 B1 * 12/2001 Troianello ..... F42B 3/124 102/202.7
8,409,378 B2 4/2013 Bley et al.
9,278,984 B2 * 3/2016 Klapotke ..... C07F 1/08
2003/0150348 A1 * 8/2003 Furusawa ..... B60R 21/2644 102/202.9
2003/0164106 A1 * 9/2003 Mueller-Fiedler ..... F42B 3/124 102/205
2003/0192445 A1 * 10/2003 Baginski ..... F42B 3/198 102/202.5
2004/0141279 A1 * 7/2004 Amano ..... F42B 3/26 361/247
2005/0183805 A1 * 8/2005 Pile ..... C06C 7/00 149/39
2006/0260498 A1 * 11/2006 Hatomoto ..... F42B 3/103 102/202.14
2008/0011179 A1 * 1/2008 Michel ..... F42C 1/04 102/275
2008/0060541 A1 * 3/2008 Fujii ..... F42B 3/128 102/202.5
2008/0156216 A1 7/2008 Yoshida et al.
2009/0223401 A1 * 9/2009 Fronabarger ..... C06C 7/00 102/202.7
2010/0000436 A1 * 1/2010 Niemeyer ..... F42B 3/124 102/202.7
2010/0031841 A1 * 2/2010 Michel ..... F42C 15/005 102/222
2010/0181748 A1 * 7/2010 Nakamura ..... F42B 3/127 280/741
2010/0199872 A1 * 8/2010 Fink ..... F42B 3/107 102/202.14
2012/0024178 A1 * 2/2012 Fronabarger ..... F42B 3/124 102/202.7
2012/0067240 A1 * 3/2012 Hartl ..... F42B 3/103 102/202
2012/0186476 A1 * 7/2012 Spring ..... E21B 43/1185 102/202.2
2012/0186477 A1 * 7/2012 Marino ..... F42B 3/124 102/202.7
2012/0234193 A1 * 9/2012 Tirmizi ..... F42B 3/125 102/202.7
2013/0032337 A1 * 2/2013 Rytlewski ..... F42B 3/117 166/250.1
2013/0199400 A1 * 8/2013 Matsuura ..... F42B 3/103 102/530

FOREIGN PATENT DOCUMENTS

FR 2885684 A1 11/2006
FR 2885684 B1 4/2012
WO 2012176198 A2 12/2012

OTHER PUBLICATIONS

Combined Office Action and Search Report dated May 3, 2017 in Chinese Patent Application No. 201380081457.3 (with English language translation).
Chinese Search Report dated Aug. 15, 2018 in corresponding Chinese Patent Application No. 201380081457.3 (2 pages).

* cited by examiner

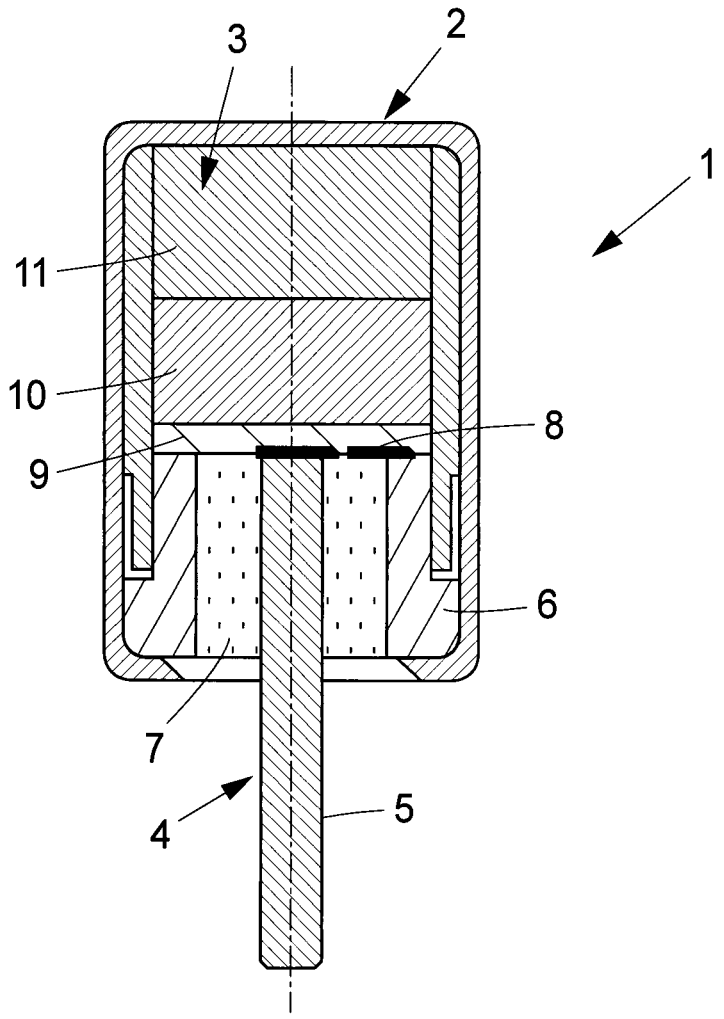
3
2
1
11
10
8
9
6
7
4
5

ELECTRIC DETONATOR AND METHOD FOR PRODUCING AN ELECTRIC DETONATOR

CROSS REFERENCE TO RELATED APPLICATIONS

This application is a National Phase filing under 35 U.S.C. § 371 of PCT/SE2013/000171 filed on Nov. 7, 2013. The entire contents of this application are hereby incorporated by reference.

TECHNICAL FIELD

The present invention relates to a lead-free electric detonator.

BACKGROUND AND PRIOR ART

Conventional electric detonators, also referred to as electric detonating caps, normally comprise primers, also referred to as primary explosives, which contain lead, for example lead azide ($Pb(N_3)_2$) or silver azide ($AgN_3$) and lead trinitroresorcinol (2,4,6-trinitrobenzene-1,3-diol). Lead trinitroresorcinol is used to increase sensitivity, especially at low temperatures.

New and intensified environmental requirements mean that lead-containing primers must be replaced with environmentally friendly alternatives. However, trials conducted with just silver azide as the primary explosive show impaired functioning at low temperatures.

There is therefore a need for lead-free electric detonators having improved low temperature characteristics. There is also a need for lead-free electric detonators which are smaller and lighter than present-day lead-free electric detonators.

OBJECT OF THE INVENTION AND ITS DISTINGUISHING FEATURES

A main object of the present invention has thus been to provide a reliable and environmentally friendly electric detonator in which lead-containing primers are replaced with environmentally friendly alternatives, chosen and configured such that the low temperature characteristics of the electric detonator have been improved.

A further object of the invention has been to provide a reliable and environmentally friendly electric detonator more compact and lighter than present-day conventional electric detonators.

The said objects, as well as other objects which are not enumerated here, are satisfactorily met by that which is defined in the present independent patent claim.

Embodiments of the invention are defined in the dependent parent claims.

Thus, according to the present invention, a functionally reliable and environmentally friendly electric detonator comprising a cap, comprising a priming charge and an electrode, comprising a positive pole, a negative pole and a resistor element, the said priming charge comprising at least two primary explosives, a first primary explosive and a second primary explosive, and at least one secondary explosive, has been provided.

Electric detonators are characterized in that the two primary explosives and the secondary explosive are arranged in layers, in an increasing degree of sensitivity, bearing one against the other, wherein the first primary explosive, constituting the most sensitive of the two primary explosives, is arranged closest to the resistor element and the second primary explosive is arranged thereafter between the first primary explosive and the secondary explosive.

According to further aspects of the electric detonator:

the positive pole of the electrode is configured as a rod or pin axially arranged in the cap and the negative pole is configured as a socket arranged coaxially to the pin, the first primary explosive comprises potassium 4,6-dinitrobenzofuroxane and the second primary explosive comprises silver azide, and the secondary explosive comprises cyclotrimethylenetrinitramine, the resistor element is configured as a thin film bridge, comprising a layer of zirconium, the pin and the socket are electrically insulated from each other via an electrical insulator, comprising steatite.

According to the present invention, a method for producing an electric detonator comprising a cap, comprising a priming charge and an electrode, comprising a positive pole and a negative pole and a resistor element, the said priming charge comprising at least two primary explosives, a first primary explosive and a second primary explosive, and at least one secondary explosive, has also been provided.

The method is characterized in that the two primary explosives and the secondary explosive are arranged in layers, in an increasing degree of sensitivity, bearing one against the other, wherein the first primary explosive, constituting the most sensitive of the two primary explosives, is arranged closest to the resistor element and the second primary explosive is arranged between the first primary explosive and the secondary explosive.

According to further aspects of the method:

the resistor element is configured as a thin film bridge, comprising a layer of zirconium, wherein the thin film bridge is produced by zirconium being evaporated through a mask in order, with a given geometry, to provide a given electrical resistance.

ADVANTAGES AND EFFECTS OF THE INVENTION

The invention signifies a number of advantages and effects, the most important being: the electric detonator is environmentally friendly, withstands a wide range of temperatures and allows a compact design. Layered application of the primary explosives and the secondary explosive in the cap allows a flexible and simple production process.

The invention has been defined in the following patent claims and will now be described in somewhat greater detail in connection with the appended FIGURE.

Further advantages and effects will emerge from a study and consideration of the following, detailed description of the invention with simultaneous reference to the appended drawing FIGURE, in which:

FIG. 1 shows in schematic representation an electric detonator having two primary explosives and a secondary explosive, arranged one upon the other in layers, adjoining a thin film bridge.

DETAILED DESCRIPTION OF EMBODIMENTS

The electric detonator 1 in FIG. 1 comprises a cap 2, which comprises a priming charge 3 and an electrode 4 for initiation of the said priming charge 3, wherein the said electrode 4 comprises a positive pole, configured as a rod or pin 5 axially arranged in the cap 2, and a negative pole, configured as a socket 6 coaxially arranged with the pin 5, the said cap 2 also comprising a resistor element 8 arranged between the pin 5 of the positive pole and the socket 6 of the negative pole. In an alternative embodiment (not shown), the negative pole is instead constituted by the pin 5 and the positive pole by the socket 6. The positive pole and the negative pole are electrically insulated from each other via an electrical insulator 7, comprising glass, a plastic or a ceramic material, such as, for example, porcelain or steatite, also referred to as soapstone.

The electric detonator 1 further comprises a resistor element 8 disposed, in bridging arrangement, between the centrally arranged pin 5 and the coaxially arranged socket 6.

The resistor element 8 is realized in the form of a thin film bridge, comprising a thin layer of zirconium.

The said thin layer bridge is, preferably, produced according to MEMS (Micro-Electro-Mechanical Systems) technology by zirconium being evaporated through a mask, wherein the thin film bridge, with a given geometry, provides a given electrical resistance.

The priming charge 2 comprises at least two primers, also referred to as primary explosives, a first primary explosive 9 and a second primary explosive 10, as well as at least one secondary explosive 11. The primary explosives 9, 10 and the secondary explosive 11 are arranged in layers, and bearing one against the other, in an increasing degree of sensitivity, wherein the first primary explosive 9 is arranged closest to the resistor element 8 and the second primary explosive 10 is arranged on the first primary explosive 9 and finally the secondary explosive 11, which is arranged on the second primary explosive 10.

The first primary explosive 9, which constitutes the more sensitive of the two primary explosives, preferably comprises potassium 4,6-dinitrobenzofuroxane (KDNBF), the second primary explosive 10 preferably comprises silver azide ($AgN_3$), and the secondary explosive 11 preferably comprises hexogen, chemical name cyclotrimethylenetrinitramine, also referred to as RDX. Alternatively, the secondary explosive 11 can comprise other types of nitramine explosives, such as, for example, octogen, chemical name cyclotetramethylene-tetranitramine octogen), also referred to as HMX, or CL-20, chemical name 2,4,6,8,10,12-hexanitro-hexaazaisowurtzitane.

In an alternative embodiment, a third primary explosive (not shown), more heat-sensitive than the first primary explosive 9, also forms part of the priming chain.

Upon initiation, the current is conducted to the resistor element 8 via the positive pole 5 of the electrode 4, and back via the negative pole socket 6 of the electrode 4. The electric pulse, which causes the priming charge 9 to ignite and the detonator 2 to detonate by burning-off of the resistor element 8, can be generated by any kind of voltage source.

Most commonly, however, the voltage source is constituted by a capacitor, wherein the capacitor discharge is generated by piezocrystals. Alternatively, the discharge can be generated by charging with battery.

The invention is not limited to the embodiments shown, but can be varied in different ways within the scope of the patent claims.

The invention claimed is:

1. An electric detonator comprising a cap, comprising: a priming charge; and an electrod, comprising a positive pole, a negative pole and a resistor element configured as a thin film bridge comprised of a layer of zirconium, and wherein:

i) said positive pole is configured as a rod or pin axially arranged in the cap, and ii) said negative pole is configured as a socket arranged coaxially to the pin; or iii) said negative pole is configured as a rod or pin axially arranged in the cap, and iv) said positive pole is configured as a socket arranged coaxially to the pin; and wherein said priming charge comprising at least two lead-free primary explosives, a first primary explosive and a second primary explosive, and at least one secondary explosive, wherein the two primary explosives and the secondary explosive are arranged in layers, in an increasing degree of heat sensitivity, bearing one against the other, wherein the first primary explosive, constituting a more heat sensitive of the two primary explosives, is arranged closest to the resistor element, and wherein the second primary explosive is arranged thereafter between the first primary explosive and the secondary explosive.

2. The electric detonator according to claim 1, wherein the positive pole of the electrode is configured as a rod or pin axially arranged in the cap, and in that the negative pole is configured as a socket arranged coaxially to the pin.

3. The electric detonator according to claim 1, wherein the first primary explosive comprises potassium 4,6-dinitrobenzofuroxane, wherein the second primary explosive comprises silver azide, and wherein the secondary explosive comprises cyclotrimethylenetrinitramine.

4. The electric detonator according to claim 1, further comprising a third primary explosive more heat-sensitive than the first primary explosive.

5. The electric detonator according to claim 1, wherein the first primary explosive comprises potassium 4,6-dinitrobenzofuroxane and the second primary explosive comprising silver azide.

6. The electric detonator according to claim 1, wherein the priming charge is ignited and the detonator is detonated by burning-off of the resistor element connected to a voltage source via the positive pole and the negative pole.

7. The electric detonator according to claim 1, wherein the resistor element is directly connected between the centrally arranged pin and the coaxially arranged socket.

8. A method for producing an electric detonator providing a cap, providing a priming charge and an electrode, providing a positive pole and a negative pole and a resistor element, said priming charge comprising at least two lead-free primary explosives, a first primary explosive and a second primary explosive, and at least one secondary explosive, arranging the two primary explosives and the secondary explosive in layers, in an increasing degree of heat sensitivity, bearing one against the other, arranging the first primary explosive, constituting a more heat sensitive of the two primary explosives, closest to the resistor element, and arranging the second primary explosive between the first primary explosive and the secondary explosive, and providing the resistor element as a thin film bridge, comprised of a layer of zirconium, producing the thin film bridge by zirconium being evaporated through a mask in order, with a given geometry, to provide a given electrical resistance.

9. The method for producing an electric detonator according to claim 8, further comprising burning-off of the resistor element connected to a voltage source via the positive pole and the negative pole to ignite the priming charge and detonate the detonator.

10. An electric detonator comprising: a cap; a priming charge; and an electrode, comprising a positive pole, a negative pole and a resistor element, said priming charge comprising at least two lead-free primary explosives, a first primary explosive and a second primary explosive, and at least one secondary explosive, wherein the two primary explosives and the secondary explosive are arranged in layers, in an increasing degree of heat sensitivity, bearing one against the other, wherein the first primary explosive, constituting a more heat sensitive of the two primary explosives, is arranged closest to the resistor element, and wherein the second primary explosive is arranged thereafter between the first primary explosive and the secondary explosive, wherein the resistor element is configured as a thin film bridge, comprised of a layer of zirconium, and wherein the thin film bridge is produced by zirconium being evaporated through a mask.

11. The electric detonator according to claim 10, further comprising burning-off of the resistor element connected to a voltage source via the positive pole and the negative pole to ignite the priming charge and detonate the detonator.

* * * * *